US009174326B2

(12) United States Patent
Ahonen

(10) Patent No.: US 9,174,326 B2
(45) Date of Patent: Nov. 3, 2015

(54) ARRANGEMENT FOR FLOOR GRINDING

(76) Inventor: Mika Ahonen, Kyröskoski (FI)

( * ) Notice: Subject to any disclaimer, the term of this patent is extended or adjusted under 35 U.S.C. 154(b) by 126 days.

(21) Appl. No.: 14/128,557

(22) PCT Filed: Jun. 1, 2012

(86) PCT No.: PCT/FI2012/050544

§ 371 (c)(1),
(2), (4) Date: Apr. 28, 2014

(87) PCT Pub. No.: WO2012/175790

PCT Pub. Date: Dec. 27, 2012

(65) Prior Publication Data

US 2014/0227950 A1 Aug. 14, 2014

(30) Foreign Application Priority Data

Jun. 23, 2011 (FI) ..... 20115647 U

(51) Int. Cl.

| | |
|---|---|
| ***B24D 7/18*** | (2006.01) |
| ***A47L 11/164*** | (2006.01) |
| ***B24D 13/14*** | (2006.01) |
| ***B24B 7/18*** | (2006.01) |

(52) U.S. Cl.

CPC ..... *B24D 7/18* (2013.01); *A47L 11/164* (2013.01); *B24B 7/18* (2013.01); *B24D 13/14* (2013.01)

(58) Field of Classification Search

CPC ..... B24D 7/18; B24D 15/00; B24D 15/02; B24D 15/06; B43L 23/006

USPC ..... 451/461, 546–551

See application file for complete search history.

(56) References Cited

U.S. PATENT DOCUMENTS

| | | | | |
|---|---|---|---|---|
| 2,121,384 | A * | 6/1938 | Gray | 15/105 |
| 2,451,295 | A * | 10/1948 | Metzger et al. | 451/548 |
| 3,346,904 | A * | 10/1967 | Armstrong | 15/230.12 |
| 4,484,419 | A * | 11/1984 | Freerks | 451/523 |
| 5,389,032 | A * | 2/1995 | Beardsley | 451/359 |
| 5,846,123 | A * | 12/1998 | Brown et al. | 451/60 |
| 5,944,586 | A * | 8/1999 | Sevigny et al. | 451/57 |
| 6,234,886 | B1 * | 5/2001 | Rivard et al. | 451/353 |

(Continued)

FOREIGN PATENT DOCUMENTS

| | | | |
|---|---|---|---|
| CN | 201350051 | Y | 11/2009 |
| DE | 102008052824 | A1 | 4/2010 |

(Continued)

OTHER PUBLICATIONS

PCT/ISA/210—International Search Report—Oct. 3, 2012 (Issued in PCT/FI2012/050544).

*Primary Examiner* — George Nguyen

(74) *Attorney, Agent, or Firm* — Venable LLP; Eric J. Franklin

(57) ABSTRACT

An arrangement for floor grinding with a floor conditioning device. A tool instrument is used in the floor conditioning device by rotating the floor conditioning device. The instrument is an essentially porous washing, polishing, waxing disk for carrying out basic functions of the floor conditioning device. A grinding instrument is removably coupled in connection with the tool instrument. A fastener couples the grinding instrument with the tool instrument by a fastening frame supported on a front surface of the tool instrument and by an auxiliary frame supported on a back surface of the tool instrument.

17 Claims, 6 Drawing Sheets

(56) References Cited

U.S. PATENT DOCUMENTS

| | | | | |
|---|---|---|---|---|
| 6,783,448 | B2 * | 8/2004 | Sabo | 451/359 |
| 7,261,621 | B2 * | 8/2007 | Moon et al. | 451/287 |
| 7,393,269 | B2 * | 7/2008 | Rambosek et al. | 451/533 |
| 8,117,709 | B2 * | 2/2012 | McLain | 15/230.18 |
| 8,210,910 | B2 * | 7/2012 | McLain | 451/524 |
| 8,251,780 | B2 * | 8/2012 | Ward et al. | 451/353 |
| 8,469,775 | B2 * | 6/2013 | Dow et al. | 451/59 |
| 2008/0072386 | A1 | 3/2008 | Kelley | |

FOREIGN PATENT DOCUMENTS

| | | | |
|---|---|---|---|
| WO | WO-9107902 | A1 | 6/1991 |
| WO | WO-9850198 | A2 | 11/1998 |

* cited by examiner

ARRANGEMENT FOR FLOOR GRINDING

CROSS-REFERENCE TO RELATED APPLICATIONS

This application claims priority to Finnish patent application 20115647 filed 23 Jun. 2011 and is the national phase of PCT/FI2012/05044 filed 1 Jun. 2012.

FIELD OF THE INVENTION

The invention relates to an arrangement for floor grinding, which is particularly meant for grinding of a floor with a floor conditioning device, such as a combination machine, floor conditioning machine or like. The arrangement comprises a tool instrument to be used in the floor conditioning device by rotating the same, the instrument being an essentially porous washing, polishing, waxing disk or like for carrying out basic functions of the floor conditioning device, and a grinding instrument, such as a diamond disk, to be coupled removably in connection with the tool instrument, or preferably several of the kind, being essentially alike and being placed symmetrically in connection with the tool instrument.

BACKGROUND OF THE INVENTION

At present, in the above mentioned context, various floor conditioning devices are being used for conditioning and maintenance of most heterogeneous floor surfaces. Combination machines in this context refer to usually top-driven or pushable conditioning machines with which e.g. washing of the floor with water is possible to be executed in a way that also water can be sucked from the floor with the machine. There may be several rotating disks in this type of a combination machine. On the other hand, e.g. pushable floor conditioning machines that use one rotating disk are also being used.

Furthermore, for more efficient floor grinding e.g. diamond disks that are coupled removably e.g. to the bottom surface of an ordinary washing, polishing or waxing disk used for floor conditioning are known to be exploited in connection with the above mentioned device types. In this way, thanks to the diamond disks attached to the disk, the same also may be used for more efficient floor grinding in addition to basic washing and conditioning procedures. For their part, in use, there are usually structurally two types of diamond disks, ie. metal bond diamond disks and on the other hand plastic bond diamond disks. Furthermore, at present in this context the diamond disks are known to be connected at simplest by e.g. sticker tape attachment to the bottom surface of a porous tool instrument, like e.g. a washing disk, in addition to which today's novelty are diamond disks attached to the washing disk's bottom surface with glue that, however, do not anymore enable the washing disk to be used in its original purpose after removal of a diamond disk glued thereto.

The rotation speed of e.g. so called slow rotation floor conditioning machines varies typically between 150-500 rpm, whereas in so called fast rotation floor conditioning machines the rotation speed may even be above 900 rpm. Therefore coupling the diamond disks only to the bottom surface of the washing disk always imposes a risk, as the diamond disk may dart at a high speed in case the washing disk is worn out, the sticker tape attachment is so to speak pilled or the glueing of the diamond disk fails, therefore imposing a work safety risk in addition to other possible damages caused.

SUMMARY OF THE INVENTION

It is an aim of the arrangement for floor grinding according to the present invention to achieve a decisive improvement in the problems described above and thus to raise essentially the level of prior art. In order to carry out this aim, the arrangement according to the invention is mainly characterized by that it comprises fastening means in order to couple the grinding instrument with the tool instrument on the one hand by a fastening frame supported on its front surface and on the other hand by an auxiliary frame supported on its back surface.

As the most important advantages of the arrangement according to the invention are the simplicity and efficiency of the structures related thereto and use thereof, thanks to one or more grinding instruments, such as diamond disks, being couplable for use in a fast and reliable manner thanks to two-sided fastening thereof to the tool instrument without the risk of e.g. inadvertent detachment of a diamond disk during grinding. The fastening means according to the invention may advantageously be implemented e.g. as a compound structure entirety made of a elastic/flexible material reaching to the opposite sides of the tool instrument.

Therefore, thanks to, the invention, a grinding instrument, e.g. a diamond disk, suitable for the purpose at any given time may be coupled to e.g. a washing disk in an easily attachable manner and removably without breaking of the washing disk in a way that the disk is as a further advantageous embodiment locked with the washing disk e.g. by anchoring means passing through the disk and/or by retaining means in the opposite attachment and auxiliary frames getting pressed onto the washing disk's outer and inner surfaces. With a coupling of the tool instrument and the grinding instrument/instruments implemented according to the arrangement of the invention, the floor conditioning procedures may be intensified decisively improving work safety at the same time.

Other advantageous embodiments of the arrangement according to the invention have been presented in the dependent claims related thereto.

BRIEF DESCRIPTION OF THE DRAWINGS

Figure 1A:
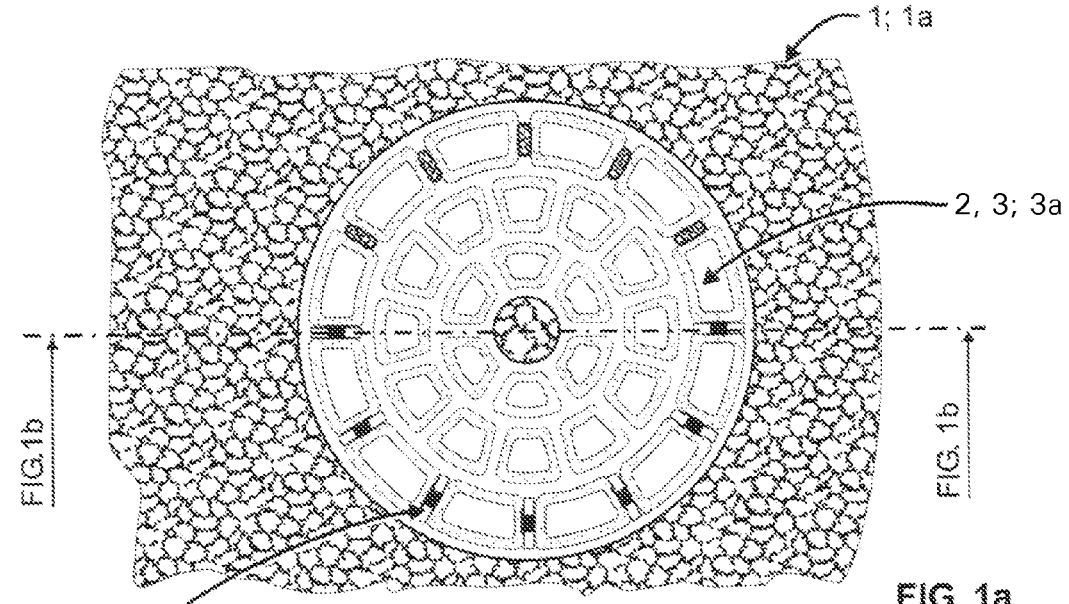
Figure 1B:
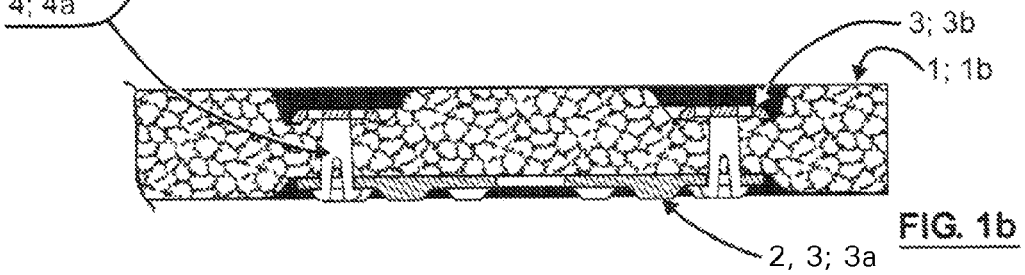
Figure 1C:
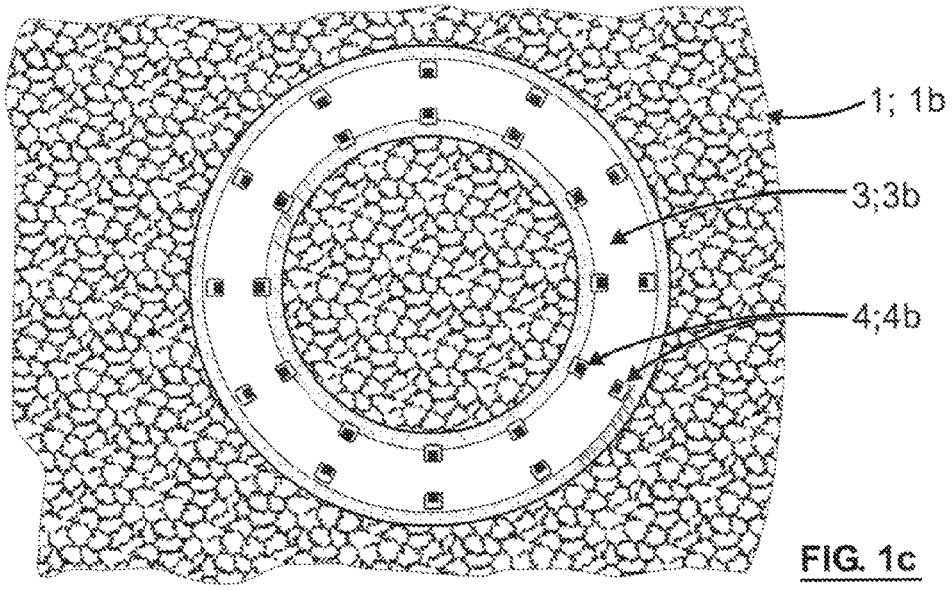
Figure 2A:
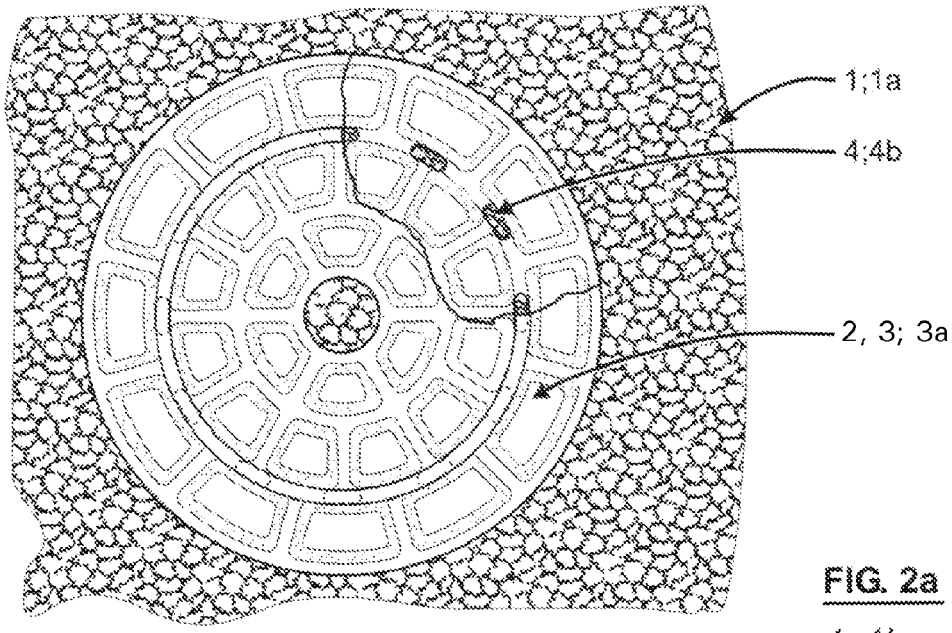
Figure 2B:
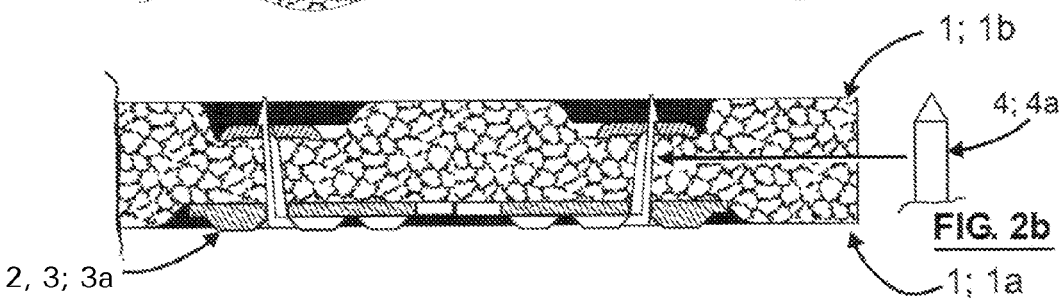
Figure 2C:
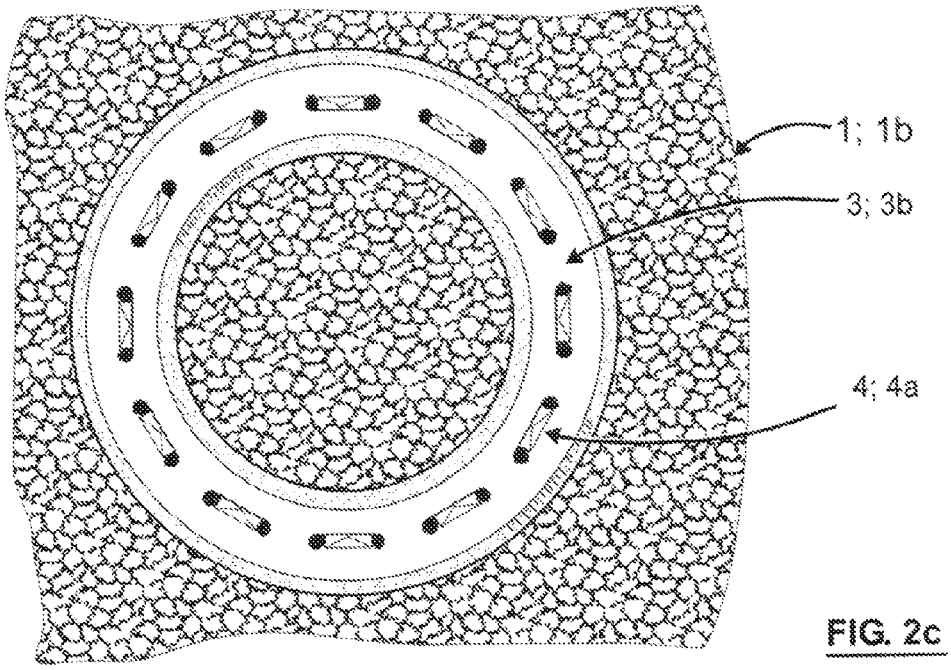
Figure 3A:
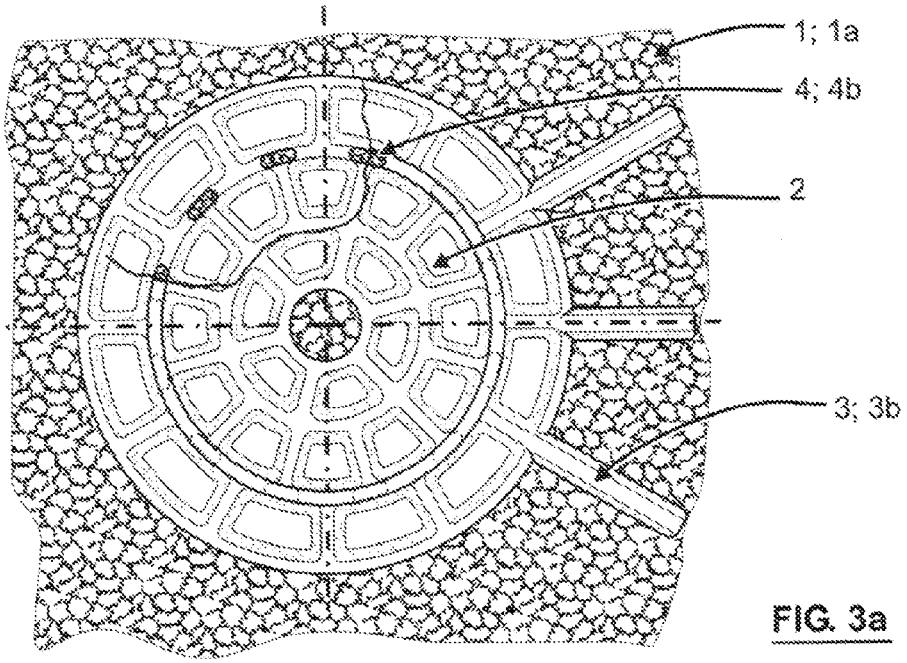
Figure 3B:
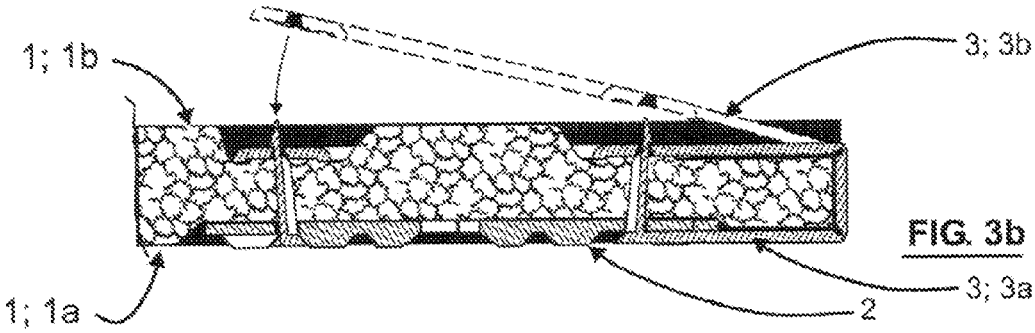
Figure 3C:
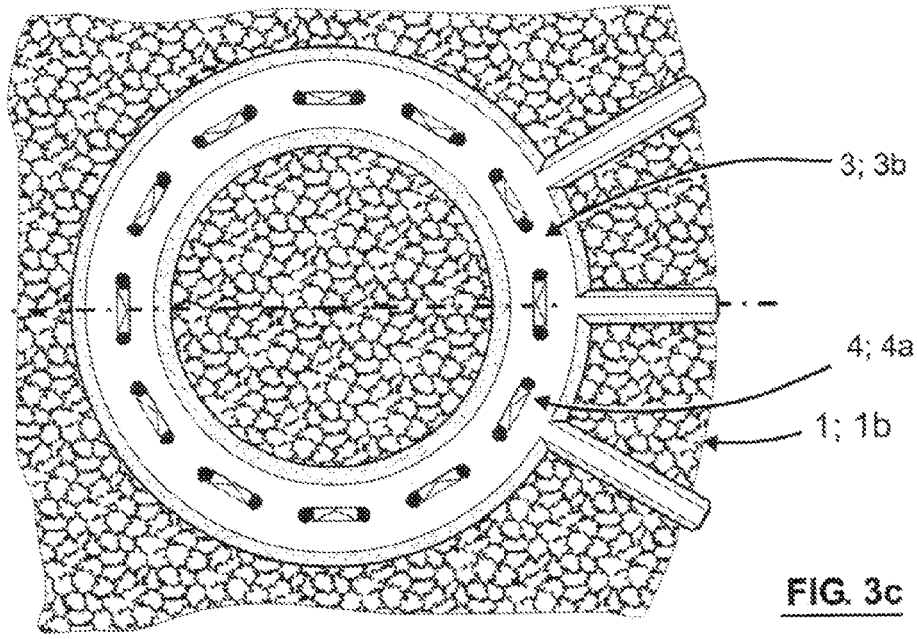
Figure 4A:
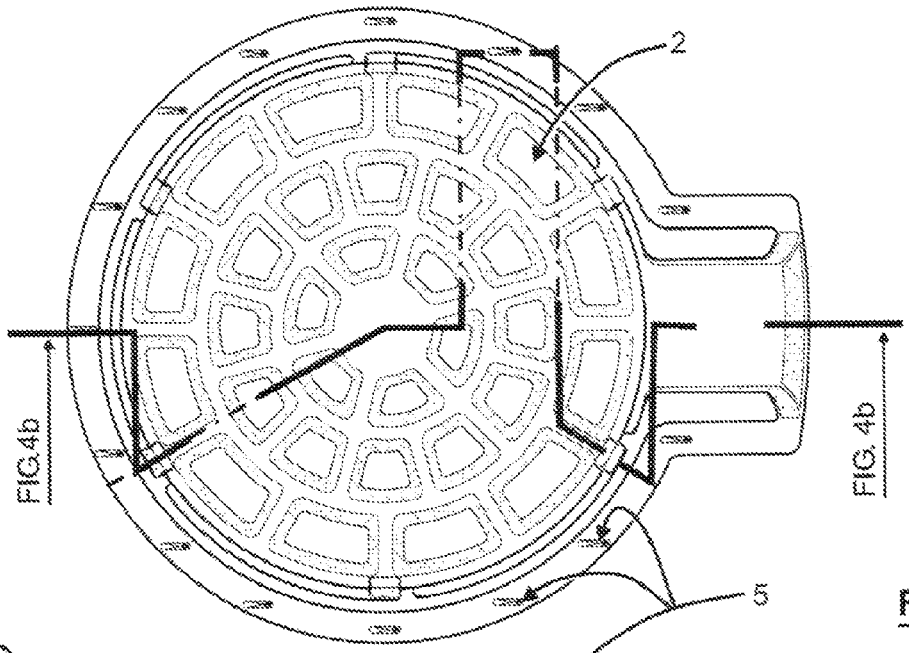
Figure 4B:
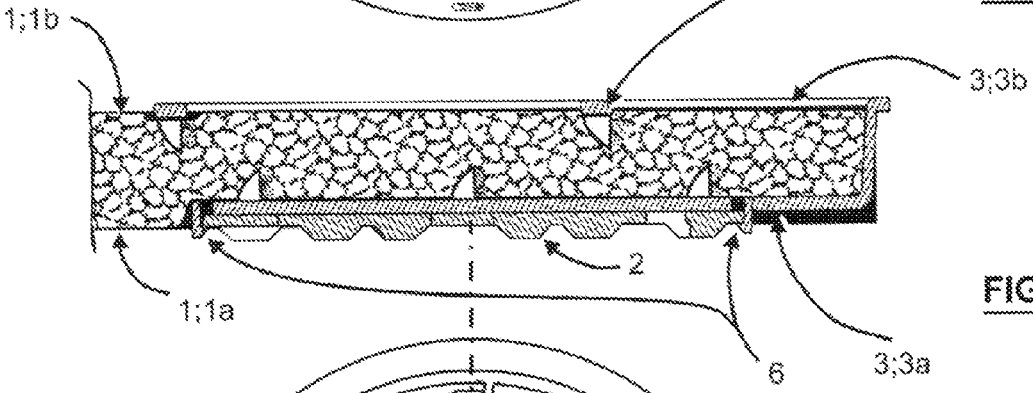
Figure 4C:
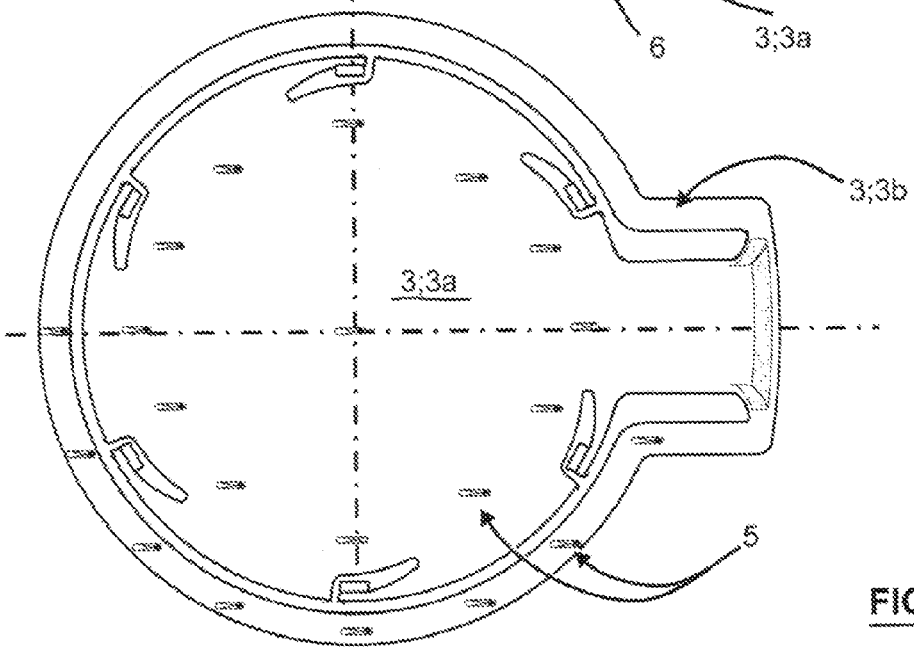
Figure 5A:
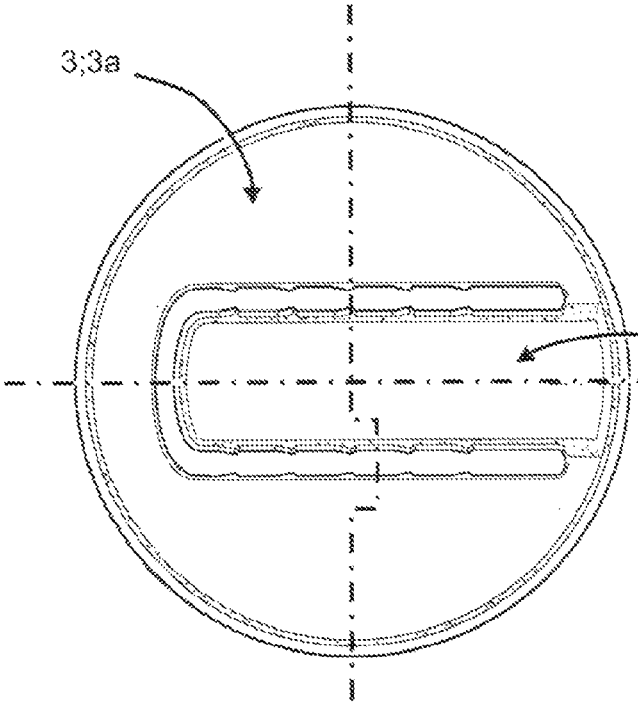
Figure 5B:
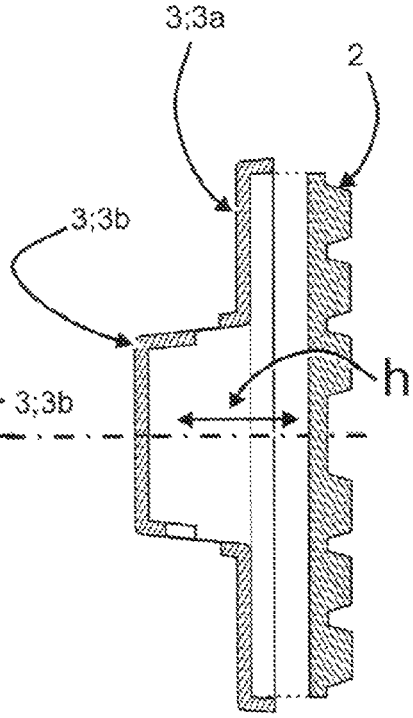
Figure 5C:
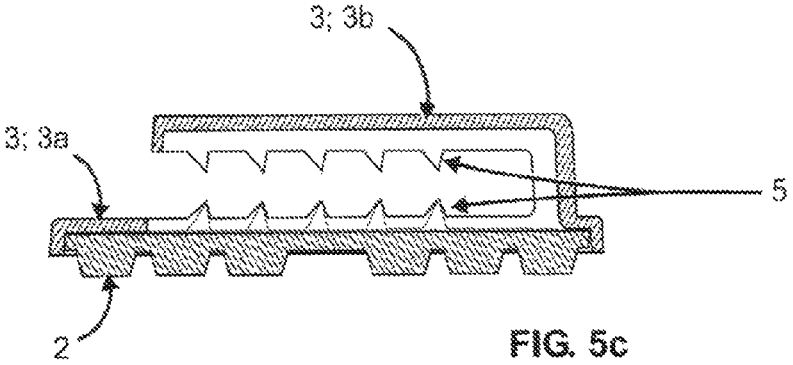
Figure 6A:
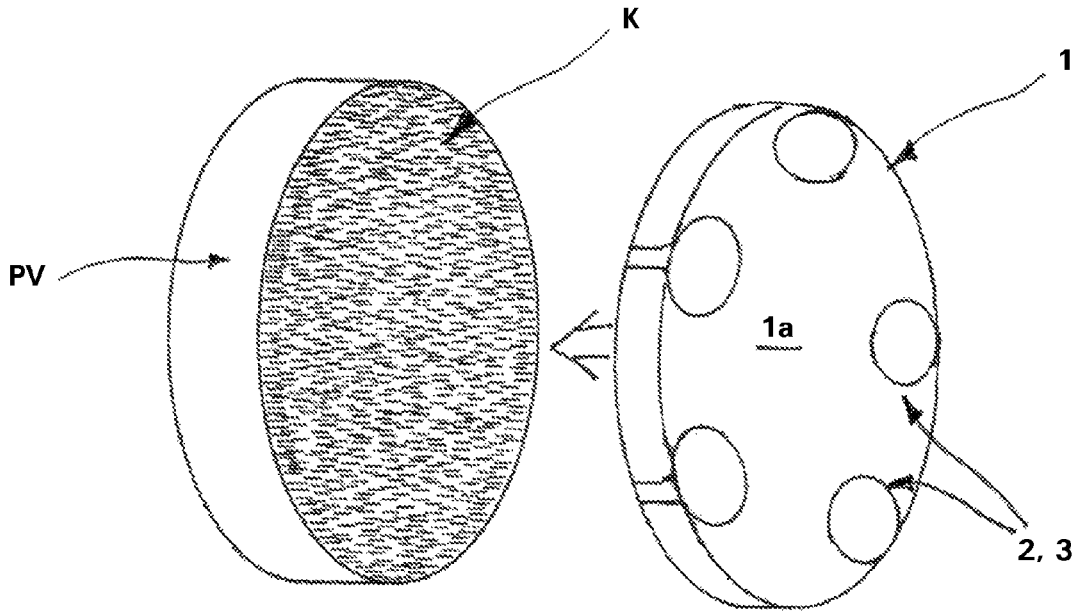
Figure 6B:
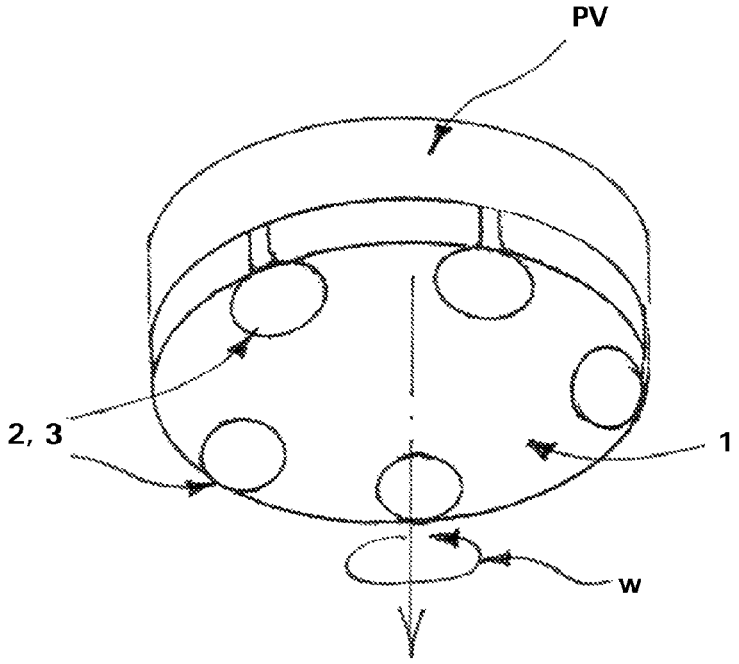

In the following description, the invention is illustrated in detail with reference to the appended drawings, in which in FIGS. 1*a*-1*c* are shown a bottom view, a cross-section view and an upper view of an advantageous arrangement according to the invention, in FIGS. 2*a*-2*c* are shown views according to FIG. 1 of another alternative arrangement according to the invention, in FIGS. 3*a*-3*c* are shown views according to FIG. 1 of a third alternative arrangement according to the invention, in FIGS. 4*a*-4*c* are shown views according to FIG. 1 of a fourth alternative arrangement according to the invention, in FIGS. 5*a*-5*c* are furthermore shown views according to FIG. 1 of a fifth alternative arrangement according to the invention, and furthermore in FIGS. 6*a* and 6*b* is firstly shown coupling of a waxing disk equipped with grinding instruments, being coupled therewith by fastening means according to the invention, to a floor conditioning device's pull platform, and on the other hand there is shown usage of the above mentioned combination in floor grinding.

DETAILED DESCRIPTION OF EMBODIMENTS OF THE INVENTION

The invention relates to an arrangement for floor grinding, which is particularly meant for grinding of a floor with a floor conditioning device, such as a combination machine, floor conditioning machine or like. The arrangement comprises a tool instrument 1 to be used in the floor conditioning device by rotating w the same, the instrument being an essentially porous washing, polishing, waxing disk or like for carrying out basic functions of the floor conditioning device, and a grinding instrument 2, such as a diamond disk, to be coupled removably in connection with the tool instrument 1, or preferably several of the kind, being essentially alike and being placed symmetrically in connection with the tool instrument 1. The arrangement comprises fastening means 3 in order to couple the grinding instrument 2 with the tool instrument 1 on the one hand by a fastening frame 3*a* supported on its front surface 1*a* and on the other hand by an auxiliary frame 3*b* supported on its back surface 1*b*.

In FIG. 6*a* is shown an advantageous embodiment of the arrangement according to the invention, in which a waxing disk 1 equipped with grinding instruments 2, being coupled therewith by fastening means 3 according to the invention, is being coupled with e.g. an ordinary floor conditioning device's pull platform PV, the fastening surface K of which typically comprises hundreds of small spikes. When the waxing disk 1 is pushed against this fastening surface, the tool instrument 1 gets stuck on its place as the spikes on the fastening surface K penetrate the porous waxing disk. After this, the waxing disk equipped with e.g. diamond disks may therefore be used for floor grinding in a way depicted in FIG. 6*b*, the disk being rotated w by the floor conditioning device.

The simplest embodiments of the invention are shown in FIGS. 1*a*-1*c* and 2*a*-2*c*, in which the fastening means 3 comprise an auxiliary frame 3*b* attached on the washing disk's back surface 1*b*, the auxiliary frame being directly couplable with the fastening frame 3*a* arranged in connection with the grinding instrument 2, such as a diamond disk, on the washing disk's front surface.

As an advantageous embodiment of the arrangement according to the invention with reference to the alternative embodiments shown in FIGS. 3*a*-3*c*, 4*a*-4*c* and 5*a*-5*c*, the fastening means 3 belonging thereto comprise a fastening frame 3*a* that is separate to the grinding instrument 2 and supported on the tool instrument's front surface 1*a* and an auxiliary frame 3*b* supported on the tool instrument's back surface 1*b*.

Furthermore, as an advantageous embodiment particularly with reference to FIGS. 1*a*-1*c*, 2*a*-2*c* and 3*a*-3*c*, the arrangement also comprises anchoring means 4 for coupling of the grinding instrument 2 and/or the fastening frame 3*a* removably with the auxiliary frame 3*b*. In this context it is advantageously also possible to use quick-release principle, such as a snap lock joint or the like.

Furthermore, as an advantageous embodiment particularly with reference to the alternatives shown in FIGS. 1*a*-1*c* and 2*a*-2*c*, the auxiliary frame 3*b* of the fastening means 3 is carried out by a separate part.

Furthermore, as an advantageous embodiment particularly with reference to the alternative embodiments shown in FIGS. 1*a*-1*c*, 2*a*-2*c*, 3*a*-3*c*, 4*a*-4*c* and 5*a*-5*c*, the fastening frame 3*a* of the fastening means 3 and the auxiliary frame 3*b* are arranged as a built-in entirety that extends on opposite sides of the tool instrument 1.

As a further advantageous embodiment, the anchoring means 4 comprise locking pins 4*a* provided with the grinding instrument, the fastening frame and/or the auxiliary frame 2, 3*a*, 3*b* in a built-in manner and going through the tool instrument 1, for getting locked with counterpart surfaces 4*b* existing in an opposite part 3*b*, 3*a*, 2.

As a further advantageous embodiment particularly with reference to the alternatives shown in FIGS. 4*a*-4*c* and 5*a*-5*c*, the grinding instrument 2, the fastening frame 3*a* and/or the auxiliary frame 3*b* is/are provided with retaining means 5 that protrude inside the tool instrument 1 through its front and/or back surface 1*a*, 1*b*.

As a further advantageous embodiment particularly with reference to the alternatives shown in FIGS. 3*a*-3*c*, 4*a*-4*c* and 5*a*-5*c*, the fastening frame 3*a* of the fastening means 3 is provided with means 6 for fastening of the grinding instrument 2 to the same chemically, such as by glueing, mechanically, such as by sticker gripping or snap lock jointing, melting, such as by welding, and/or in a corresponding manner.

Particularly in the advantageous embodiments shown in FIGS. 3*a*-3*c*, 4*a*-4*c* and 5*a*-5*c*, the fastening means 3 are arranged as a built-in entirety extending on opposite sides of the tool instrument 1 and being manufactured from elastic/flexible material, wherein the fastening and the auxiliary frames 3*a*, 3*b* positioned against the front and back surfaces 1*a*, 1*b* of the tool instrument, are provided as a furthermore advantageous embodiment with e.g. retaining means 5 extending inside the tool instrument.

Furthermore, in the advantageous embodiment shown in FIGS. 5*a*-5*c*, the fastening frame 3*a* of the fastening means 3 is provided with an opening A at a corresponding point as the auxiliary frame 3*b*, when viewed in a direction of height h perpendicular to a plane defined by the tool instrument 1. In this manner minimizing of the amount of material needed for manufacturing the fastening means is enabled.

It is clear that the invention is not limited to the embodiments shown or described above, but it can be modified within the basic idea of the invention in very many ways, e.g. by combining the embodiments shown in the appended figures together etc. Also the types of implementations that are mentioned above may be executed structurally in different ways regarding structure or appearance thereof etc. than what is described above. The part entireties of the arrangement according to the invention may in addition be manufactured from a variety of materials, exploiting a variety of manufacturing techniques using plastic, ceramic, composite, carbon fibre materials or the like, without forgetting metal structures, such as light alloy implementations.

The invention claimed is:

1. An arrangement for floor grinding with a floor conditioning device, the arrangement comprising:

a tool instrument to be used in the floor conditioning device by rotating the floor conditioning device, the instrument comprising an essentially porous washing, polishing, waxing disk for carrying out basic functions of the floor conditioning device, a grinding instrument removably coupleable with the tool instrument, and a fastener configured to couple the grinding instrument with the tool instrument on the one hand by a fastening frame supported on a front surface of the tool instrument and on the other hand by an auxiliary frame supported on a back surface of the tool instrument.

2. The arrangement according to claim 1, further comprising:

an anchor configured to removably couple at least one of the grinding instrument or the fastening frame with the auxiliary frame.

3. The arrangement according to claim 2, wherein the anchor is arranged to be locked on quick-release principle.

4. The arrangement according to claim 1, wherein the auxiliary frame of the fastener is carried out by a separate part.

5. The arrangement according to claim 1, wherein the fastening frame of the fastener and the auxiliary frame are arranged as a built-in entirety that extends on opposite sides of the tool instrument.

6. The arrangement according to claim 2, wherein the anchor comprises a lock provided with at least one of the grinding instrument, the fastening frame or the auxiliary frame in a built-in manner and going through the tool instrument, wherein the lock is configured to be locked with a counterpart element arranged in an opposite part.

7. The arrangement according to claim 1, wherein at least one of the grinding instrument, the fastening frame or the auxiliary frame comprises a retainer that protrudes inside the tool instrument through at least one of a front surface or a back surface of the tool instrument.

8. The arrangement according to claim 1, wherein the fastening frame of the fastener comprises a chemical fastener configured to chemically fasten the fastening frame to the grinding instrument.

9. The arrangement according to claim 1, wherein the fastener is arranged as a built-in entirety extending on opposite sides of the tool instrument and being manufactured from elastic/flexible material, wherein the fastening and the auxiliary frames positioned against the front and back surfaces of the tool instrument comprises a retainer.

10. The arrangement according to claim 9, wherein the fastening frame of the fastener comprises an opening at a corresponding point as the auxiliary frame, when viewed in a direction of height perpendicular to a plane defined by the tool instrument.

11. The arrangement according to claim 1, wherein the floor conditioning device comprises a combination machine, floor conditioning machine.

12. The arrangement according to claim 1, wherein the grinding instrument comprises a diamond disk.

13. The arrangement according to claim 12, wherein the arrangement comprises a plurality of diamond disks.

14. The arrangement according to claim 13, wherein the plurality of diamond disks are symmetrically arranged in connection with the tool instrument.

15. The arrangement according to claim 3, wherein the anchor is arranged to be locked by a snap lock joint.

16. The arrangement according to claim 1, wherein the fastening frame of the fastener is welded the fastening frame to the grinding instrument.

17. The arrangement according to claim 9, wherein the retainer extends inside the tool instrument.

* * * * *